US006666634B1

(12) United States Patent
Hsieh

(10) Patent No.: US 6,666,634 B1
(45) Date of Patent: Dec. 23, 2003

(54) POSITIONING ASSEMBLY FOR POSITIONING A CONTAINER ON A PLATFORM

(76) Inventor: David Hsieh, 3F, No. 2, Chin-Chung St., Taichung City (TW)

( * ) Notice: Subject to any disclaimer, the term of this patent is extended or adjusted under 35 U.S.C. 154(b) by 0 days.

(21) Appl. No.: 10/335,507

(22) Filed: Dec. 31, 2002

(51) Int. Cl.[7] ..... B63B 25/24

(52) U.S. Cl. ..... 410/85; 114/75; 410/100; 410/81

(58) Field of Search ..... 410/85, 96, 97, 410/77, 80, 81, 100; 114/75; 248/499

(56) References Cited

U.S. PATENT DOCUMENTS 632,997 A * 9/1899 Gilkey
3,416,763 A * 12/1968 Moreno
5,143,010 A * 9/1992 Behr et al. ..... 114/75
6,161,981 A * 12/2000 Dehlin ..... 410/100

* cited by examiner

*Primary Examiner*—Joseph D. Pape
*Assistant Examiner*—H. Gutman
(74) *Attorney, Agent, or Firm*—Christie, Parker & Hale, LLP

(57) ABSTRACT

A positioning assembly includes an elongated container-connecting unit with a lower connecting seat formed with a threaded hole, a platform-connecting rod with an externally threaded portion for engaging the threaded hole and an upper end surface formed with a limiting stud, which has a non-circular cross-sectioned engaging stud portion, and a limiting seat formed with a limiting hole, which has a non-circular engaging hole portion that engages fittingly the engaging stud portion to arrest rotation of the platform-connecting rod within the threaded hole, thereby positioning the platform-connecting rod relative to the container-connecting unit.

5 Claims, 5 Drawing Sheets

POSITIONING ASSEMBLY FOR POSITIONING A CONTAINER ON A PLATFORM

BACKGROUND OF THE INVENTION

1. Field of the Invention

The invention relates to a positioning assembly for positioning a container on a platform of a vehicle.

2. Description of the Related Art

Containers are usually positioned on a platform of a vehicle, such as a cargo ship, through extension rods and positioning assemblies. A conventional positioning assembly includes a container-connecting unit connected to an extension rod, and a platform-connecting rod that has an externally threaded portion engaging the container-connecting unit and that has a connecting end portion connected to a fitting of the platform of the vehicle.

Although the conventional positioning assembly can achieve its intended purpose, in actual use, due to undesired movement of the containers on the platform caused by repeated swaying of the ship on the sea surface, the container-connecting unit of the conventional positioning assembly tends to loosen rotatably such that the conventional positioning assembly is rendered ineffective. Even if a positioning nut is disposed threadedly on one end of the platform-connecting rod of the conventional positioning assembly, the container-connecting unit can still rotate out of the platform-connecting rod, thereby rendering the conventional positioning assembly similarly ineffective.

SUMMARY OF THE INVENTION

Therefore, the main object of the present invention is to provide a positioning assembly that is capable of overcoming the aforementioned drawbacks of the prior art.

According to the present invention, a positioning assembly is adapted for positioning a container on a platform, and comprises an elongated container-connecting unit, a platform-connecting rod, and a limiting seat. The container-connecting unit includes an upper end adapted to be connected to the container, a lower end with a lower connecting seat that has a threaded hole formed therethrough, and two parallel support rods extending from the upper end to the lower end along a longitudinal direction of the container-connecting unit and connected fixedly to the lower connecting seat. The platform-connecting rod is adapted to be connected to the platform, and includes an externally threaded portion engaging the threaded hole in the lower connecting seat of the container-connecting unit, and an upper end surface that is formed with a limiting stud, which has a non-circular cross-sectioned engaging stud portion. The limiting seat is mounted slidably along the container-connecting unit, and has a bottom surface that abuts against the upper end surface of the platform-connecting rod. The limiting seat is formed with a limiting hole therethrough, which has a non-circular cross-sectioned engaging hole portion that engages fittingly the engaging stud portion of the limiting stud so as to arrest rotation of the externally threaded portion of the platform-connecting rod within the threaded hole in the lower connecting seat of the container-connecting unit, thereby positioning the platform-connecting rod relative to the container-connecting unit. The limiting seat is movable relative to the platform-connecting rod so as to disengage the engaging stud portion from the engaging hole portion, thereby permitting rotation of the platform-connecting rod within the threaded hole in the lower connecting seat.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
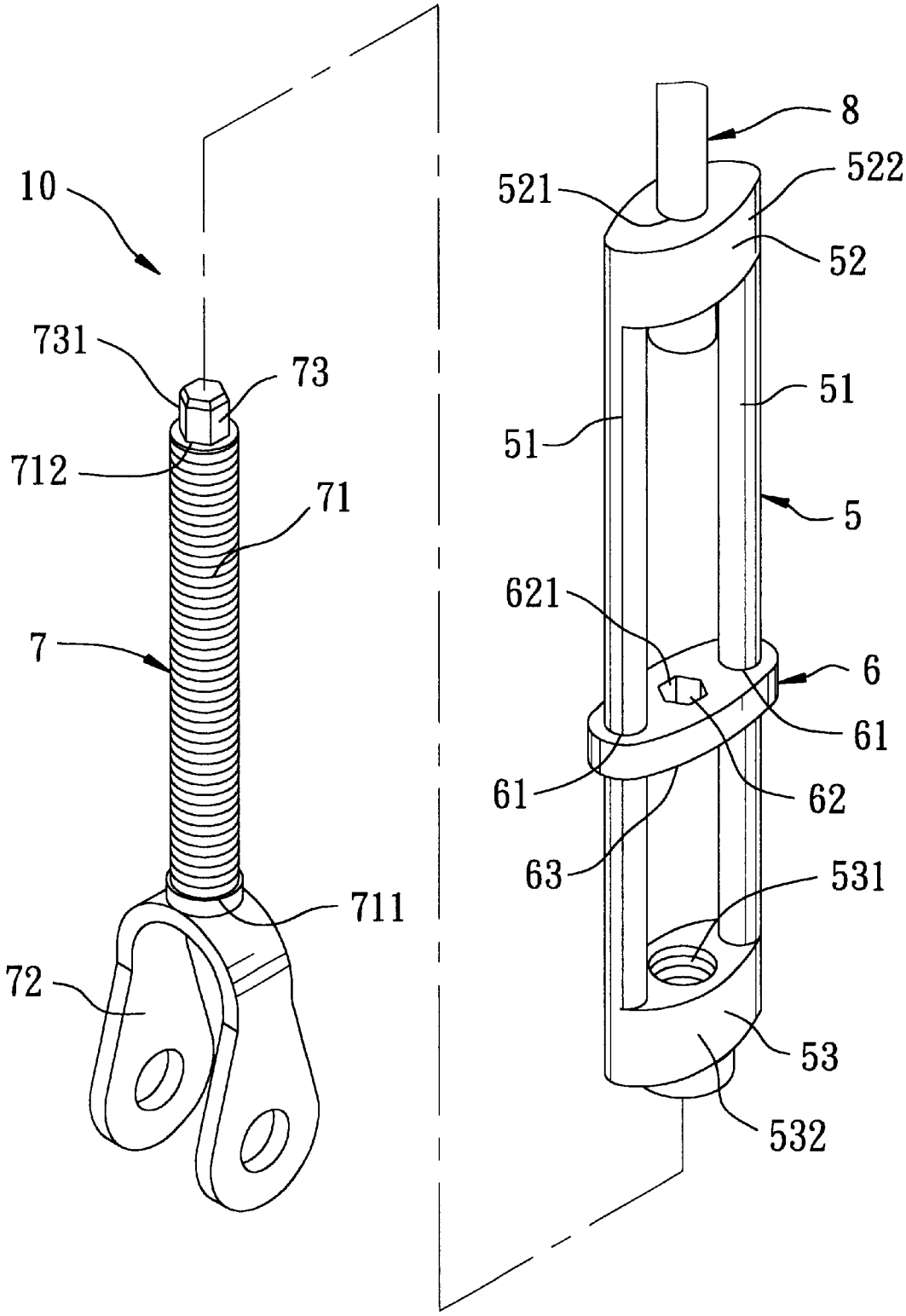
FIG. 1 is a partly exploded perspective view of the first preferred embodiment of a positioning assembly according to the present invention, illustrating a container-connecting unit, a platform-connecting rod, and a limiting seat of the first preferred embodiment.
Figure 2:
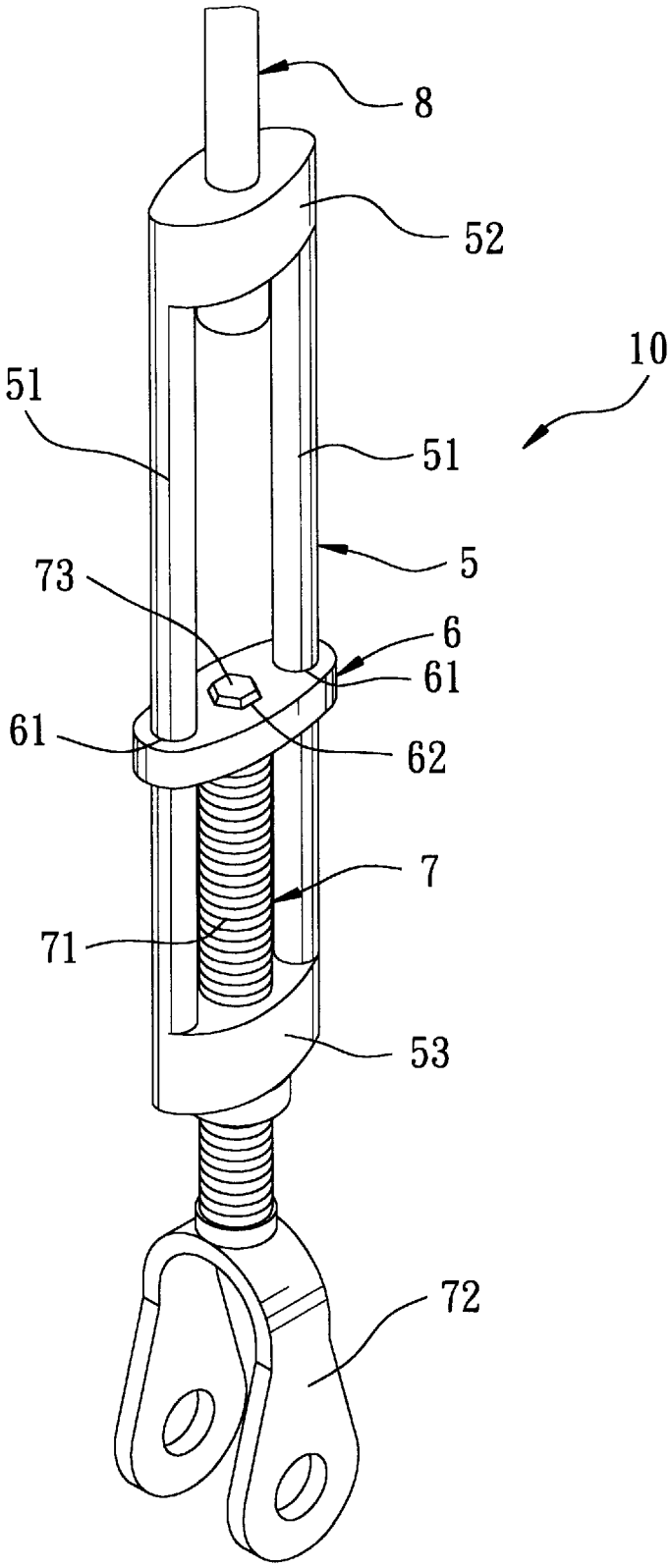
FIG. 2 is a perspective view of the first preferred embodiment in an assembled state.

Before the present invention is described in greater detail, it should be noted that like elements are denoted by the same reference numerals throughout the disclosure.

Referring to FIGS. 1 to 4, the first preferred embodiment of a positioning assembly 10 according to the present invention is adapted for positioning a container 9 on a platform 11 of a vehicle, such as a cargo ship (not shown), and is shown to comprise an elongated container-connecting unit 5, a platform-connecting rod 7, and a limiting seat 6.

The container-connecting unit 5 includes an upper end 52, a lower end 53, and two parallel support rods 51. The upper end 52 is adapted to be connected to the container 9, and has an upper connecting seat 522 formed with a through hole 521 for extension of an extension rod 8 therethrough. The extension rod 8 has an enlarged lower end, which has a diameter substantially larger than that of the throughhole 521 in the upper connecting seat 522. The lower end 53 of the container-connecting unit 5 has a lower connecting seat 532 formed with a threaded hole 531 therethrough. The support rods 51 extend from the upper end 52 to the lower end 53 along a longitudinal direction of the container-connecting unit 5, and are connected fixedly to the lower connecting seat 53.

The platform-connecting rod 7 is adapted to be connected to the platform 11, and includes an externally threaded portion 71 engaging the threaded hole 531 in the lower connecting seat 532 of the container-connecting unit 5, an inverted-U connector 72 provided on a lower end 711 of the externally threaded section 71, and an upper end surface 712 that is formed with a limiting stud 73, which has a non-circular cross-sectioned engaging stud portion 731. In this embodiment, the engaging stud portion 731 has a hexagonal cross-section.

The limiting seat 6 is mounted slidably along the container-connecting unit 5, and has a bottom surface 63 that abuts against the upper end surface 712 of the platform-connecting rod 7. The limiting seat 6 is formed with a limiting hole 62 therethrough, which has a non-circular cross-sectioned engaging hole portion 621 that engages fittingly the engaging stud portion 731 of the limiting stud 73 so as to arrest rotation of the externally threaded portion 71 of the platform-connecting rod 7 within the threaded hole 531 in the lower connecting seat 532 of the container-connecting unit 5, thereby positioning the platform-connecting rod 7 relative to the container-connecting unit 5. In this embodiment, the engaging hole portion 621 has a hexagonal cross-section. The limiting seat 6 further has two through holes. 61 formed therethrough and located on two opposite sides of the limiting hole 62. The through holes 61 in the limiting seat 6 are provided for extension of the support rods 51 therethrough so that the limiting seat 6 is slidable along the support rods 51. The limiting seat 6 is movable relative to the platform-connecting rod 7 so as to disengage the engaging stud portion 731 from the engaging hole portion 621, thereby permitting rotation of the platform-connecting rod 7 within the threaded hole 531 in the lower connecting seat 532.

Figure 3:
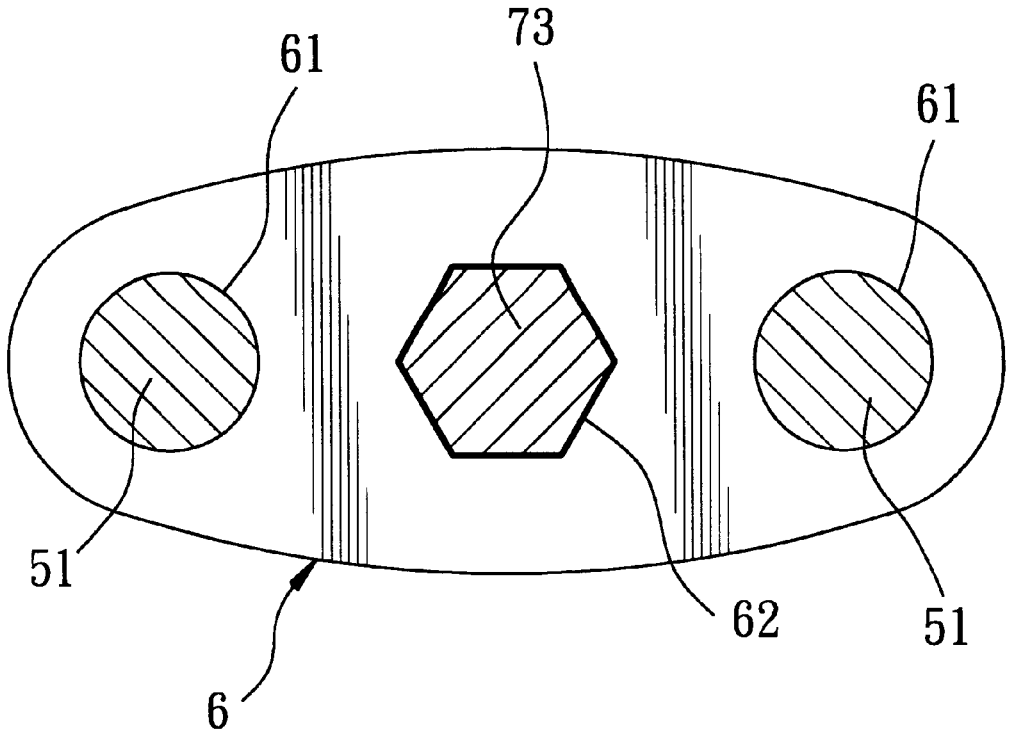
FIG. 3 is a top schematic sectional view of the first preferred embodiment, illustrating how a non-circular cross-sectioned engaging hole portion of the limiting seat engages fittingly an engaging stud portion of a limiting stud of the platform-connecting rod, and how support rods of the container-connecting unit extend respectively through through holes in the limiting seat.
Figure 4:
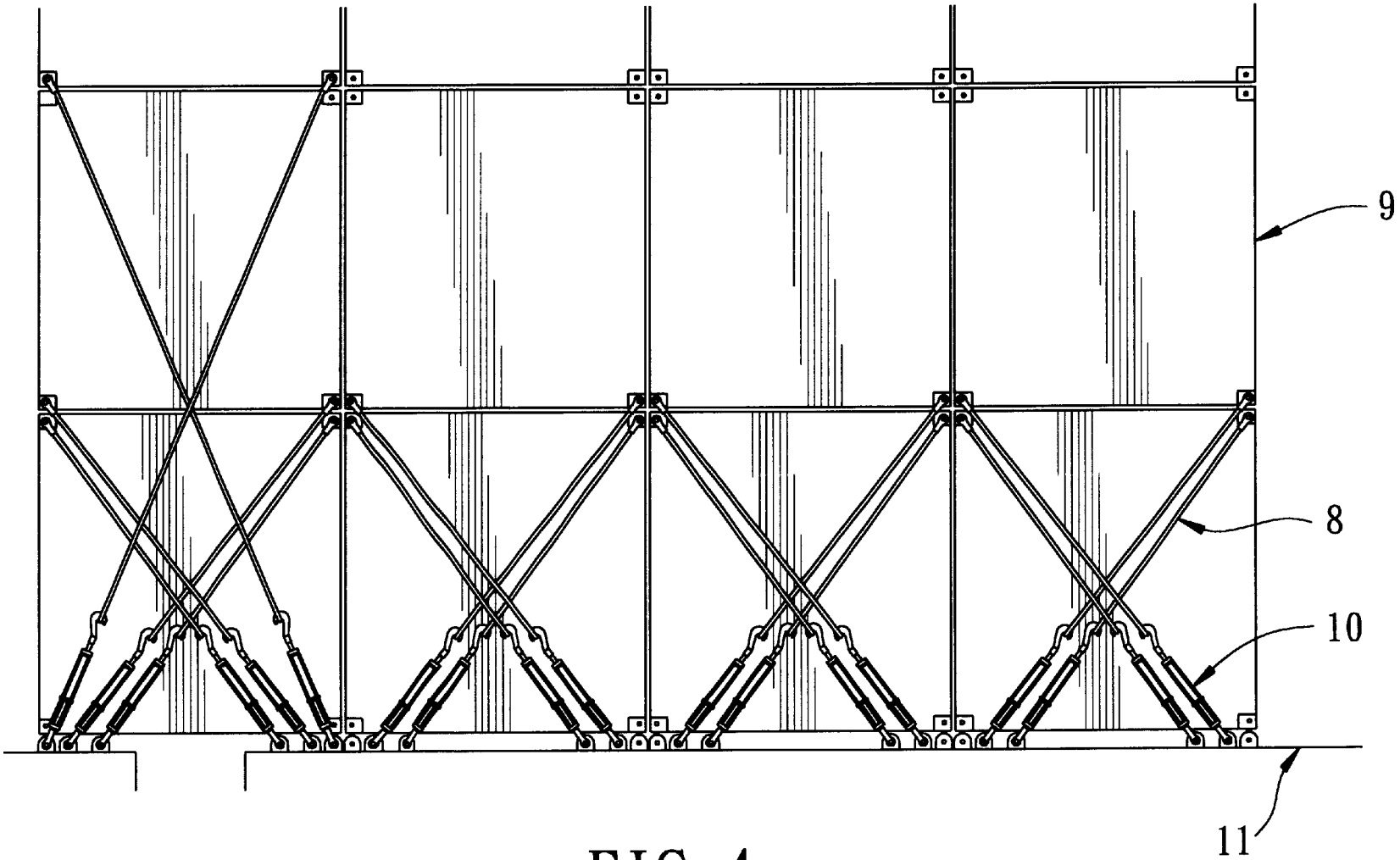
FIG. 4 is a schematic view of the first preferred embodiment in a state of use.

In use, after the platform-connecting rod 7 is connected to the container-connecting unit 5, one end of the extension rod 8 is engaged to the upper connecting seat 521 of the container-connecting unit 5, whereas the other end of the extension rod 8 is connected to a fitting (not shown) of the container 9. At the same time, the inverted-U connector 72 of the platform-connecting rod 7 is engaged to a fitting (not shown) of the platform 11 of the cargo ship. Afterwards, the limiting seat 6 is lightly tapped, and due to its own weight, the limiting seat 6 slides downwardly along the support rods 51 until the engaging hole portion 621 of the limiting hole 62 in the limiting seat 6 engages fittingly the engaging stud portion 731 of the limiting stud 73 of the platform-connecting rod 7, as best shown in FIG. 3, thereby positioning the platform-connecting rod 7 on the container-connecting unit 5. Since each of the positioning assembly 10 and the extension rod 8 is in an inclined position, as shown in FIG. 4, the support rods 51 of the container-connecting unit 5 can restrain movement of the limiting seat 6 such that when the cargo ship repeatedly sways on the sea surface, the limiting seat 6 can maintain engagement with the limiting stud 73 of the platform-connecting rod 7. Furthermore, since the inverted-U connector 72 of the platform-connecting rod 7 is connected fixedly and non-rotatably to the fitting of the platform 11 of the cargo ship, the limiting seat 6 and the connecting rod 7 cannot rotate relative to each other, thereby preventing movement of the externally threaded portion 71 of the platform-connecting rod 7 relative to the container-connecting unit 5, and thereby positioning stably the container 9 on the cargo ship.

FIG. 4 illustrates the positioning assembly 10 of the present invention in a state of actual use, wherein a plurality of the positioning assemblies 10 and a plurality of the extension rods 8 cooperate to stably position the containers 9 on the platform 11 of the cargo ship.

Figure 5:
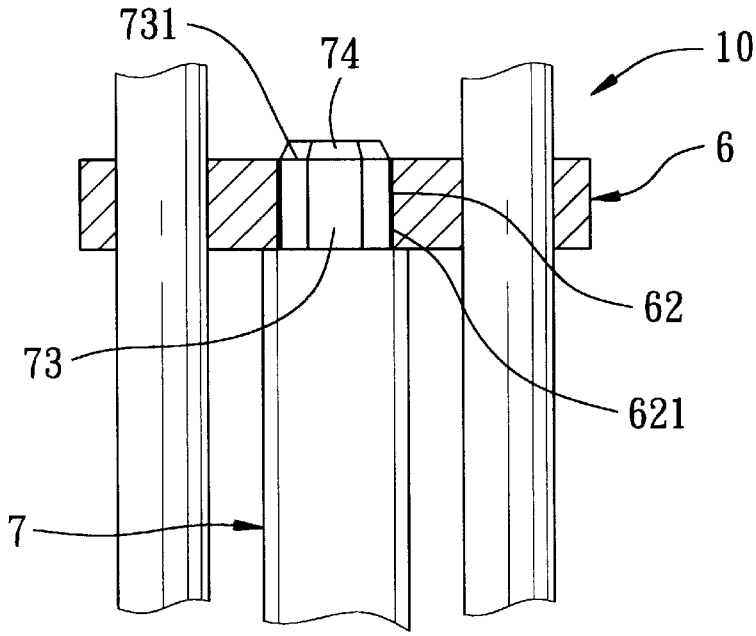
FIG. 5 is a fragmentary partly sectional view of the second preferred embodiment of a positioning assembly according to the present invention.

Referring to FIG. 5, the second preferred embodiment of the positioning assembly 10 according to the present invention is shown to be substantially similar to the first preferred embodiment. In this embodiment, the platform-connecting rod 7 further includes a guide portion 74 that extends upwardly and convergingly from the non-circular cross-sectioned engaging stud portion 731 of the limiting stud 73, thereby guiding movement of the engaging stud portion 731 of the limiting stud 73 into the engaging hole portion 621 of the limiting hole 62 in the limiting seat 6 when the limiting seat 6 moves downwardly toward the platform-connecting rod 7.

Figure 6:
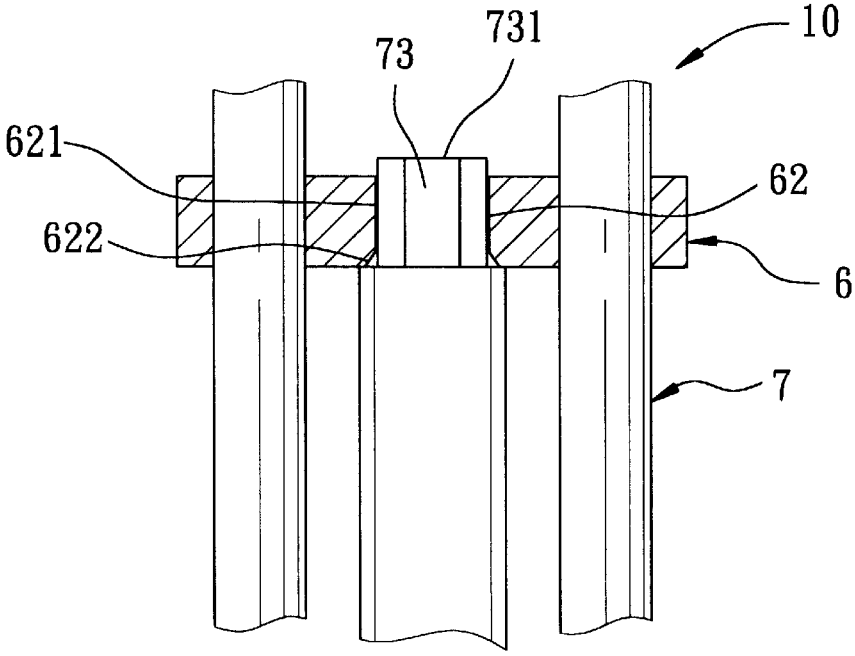
FIG. 6 is a fragmentary partly sectional view of the third preferred embodiment of a positioning assembly according to the present invention.

Referring to FIG. 6, the third preferred embodiment of the positioning assembly 10 according to the present invention is shown to be substantially similar to the first preferred embodiment. However, in this embodiment, the limiting hole 62 in the limiting seat 6 further has a downwardly diverging hole portion 622 at a lower end thereof so as to guide movement of the engaging stud portion 731 of the limiting stud 73 into the engaging hole portion 621 of the limiting hole 62 in the limiting seat 6 when the limiting seat 6 moves downwardly toward the platform-connecting rod 7.

From the above description of the preferred embodiments of the positioning assembly 10 of the present invention, the advantages of the positioning assembly 10 of the present invention can be summarized as follows:

Due to coordination of the polygonal engaging hole portion 621 of the limiting hole 62 in the limiting seat 6 and the polygonal engaging stud portion 731 of the limiting stud 73 of the platform-connecting rod 7, the container-connecting unit 5 and the platform-connecting rod 7 cannot rotate relative to each other, thereby preventing relative movement between the container-connecting unit 5 and the platform-connecting rod 7, and thereby positioning stably the container 9 on the platform 11 of the cargo ship. Furthermore, due to the weight of the limiting seat 6, it is only necessary to tap the limiting seat 6 so as to slide downwardly along the support rods 51 so that the limiting hole 62 in the limiting seat 6 can engage the limiting stud 73 of the platform-connecting rod 7, thereby completing the positioning process, and thus making the positioning assembly 10 of the present invention simple and convenient to use.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A positioning assembly for positioning a container on a platform, said positioning assembly comprising:

an elongated container-connecting unit including an upper end adapted to be connected to the container, a lower end with a lower connecting seat that has a threaded hole formed therethrough, and two parallel support rods extending from said upper end to said lower end along a longitudinal direction of said container-connecting unit and connected fixedly to said lower connecting seat;

a platform-connecting rod adapted to be connected to the platform and including an externally threaded portion engaging said threaded hole in said lower connecting seat of said container-connecting unit, and an upper end surface that is formed with a limiting stud, which has a non-circular cross-sectioned engaging stud portion; and a limiting seat mounted slidably along said container-connecting unit and having a bottom surface that abuts against said upper end surface of said platform-connecting rod, said limiting seat being formed with a limiting hole therethrough, which has a non-circular cross-sectioned engaging hole portion that engages fittingly said engaging stud portion of said limiting stud so as to arrest rotation of said externally threaded portion of said platform-connecting rod within said threaded hole in said lower connecting seat of said container-connecting unit, thereby positioning said platform-connecting rod relative to said container-connecting unit, said limiting seat being movable relative to said platform-connecting rod so as to disengage said engaging stud portion from said engaging hole portion, thereby permitting rotation of said platform-connecting rod within said threaded hole in said lower connecting seat.

2. The positioning assembly of claim 1, wherein said limiting seat further has two through holes formed therethrough and located on two sides of said limiting hole, said support rods extending through said through holes, respectively, so that said limiting seat is slidable along said support rods.

3. The positioning assembly of claim 1, wherein said platform-connecting rod further includes a guide portion that extends upwardly and convergingly from said non-circular cross-sectioned engaging stud portion of said limiting stud, thereby guiding movement of said engaging stud portion of said limiting stud into said engaging hole portion of said limiting hole in said limiting seat when said limiting seat moves downwardly toward said platform-connecting rod.

4. The positioning assembly of claim 1, wherein said limiting hole in said limiting seat further has a downwardly diverging hole portion at a lower end thereof so as to guide movement of said engaging stud portion of said limiting stud into said engaging hole portion of said limiting hole in said limiting seat when said limiting seat moves downwardly toward said platform-connecting rod.

5. The positioning assembly of claim 1, wherein each of said engaging hole portion and said engaging stud portion has a hexagonal cross-section.

* * * * *